US006644474B1

(12) United States Patent
Lai

(10) Patent No.: US 6,644,474 B1
(45) Date of Patent: Nov. 11, 2003

(54) TOOL BOX

(76) Inventor: Pao-Chung Lai, No. 170, Pu Tz Keng Rd., Tai Ping City, Taichung Hsien (TW)

( * ) Notice: Subject to any disclaimer, the term of this patent is extended or adjusted under 35 U.S.C. 154(b) by 0 days.

(21) Appl. No.: 10/357,771

(22) Filed: Feb. 4, 2003

(51) Int. Cl.[7] ..... B65D 85/20
(52) U.S. Cl. ..... 206/378; 206/372
(58) Field of Search ..... 206/249, 372–378, 206/379, 443, 493; 211/69, 70.6

(56) References Cited

U.S. PATENT DOCUMENTS 5,813,531 A * 9/1998 Kao ..... 206/378
5,931,318 A * 8/1999 Shauo ..... 206/378
6,079,559 A * 6/2000 Lee ..... 206/378
6,098,799 A * 8/2000 Lee ..... 206/378
6,364,109 B1 * 4/2002 Blackwell ..... 206/378
6,508,360 B1 * 1/2003 Chen ..... 206/378

* cited by examiner

*Primary Examiner*—Luan K. Bui
(74) *Attorney, Agent, or Firm*—Charles E. Baxley

(57) ABSTRACT

A tool box comprises a first casing body, a second casing body, and a hinge is integrally connected between the first casing body and the second casing body. The first casing body has a plurality of compartments respectively defined by a partition. Each of the compartments is integrally formed with a baffling section. The second casing body has a plurality of compartments respectively defined by a partition corresponding to those in the first casing body. Each of the compartments has a baffling section formed at an opened end of thereof, two retainers extending from one side of the second casing body remote from the hinge, and adapted for coupling to respective the retainer recesses at the first casing body when the two casing bodies rotatably closing together.

4 Claims, 10 Drawing Sheets

TOOL BOX

BACKGROUND OF THE INVENTION

1. Field of the Invention

The present invention relates to a tool box, and more particularly to a tool box which has no need of covers.

2. Description of the Related Prior Art

A conventional tool box comprises a casing 10 and two covers 20, as shown in FIG. 1, at both sides of the casing 10 are oppositely defined with a plurality of compartments 11 in each of which a socket 12 is received, each of hinges 13 is integrally connected between the casing 10 and the cover 20. The tool box can be closed by virtue of the covers. 20 to keep the socket 12 without dropping out. Obviously, in this conventional tool box, not only the covers 20 will increase the production cost, but also it is not convenient to use because it requires a space to be left in order to open the covers 20 to take out the socket 12 from the compartments 11 of the casing 10.

The present invention has arisen to mitigate and/or obviate the afore-described disadvantages of the conventional tool box.

SUMMARY OF THE INVENTION

In accordance with the present invention there is provided an improved tool box which comprises two casing bodies, a hinge is integrally connected between the two casing bodies, each of the two casing bodies is oppositely defined with a plurality of compartments in each of which a socket is received. The compartments in one casing bodies are respectively corresponding to those in another.

The primary object of the present invention is to provide a tool box which is able to keep sockets without covers so as to save cost and occupied space.

The present invention will become more obvious from the following description when taken in connection with the accompanying drawings, which shown for purpose of illustration only, the preferred embodiments in accordance with the present invention.

DETAILED DESCRIPTION OF THE PREFERRED EMBODIMENTS

Figure 1:
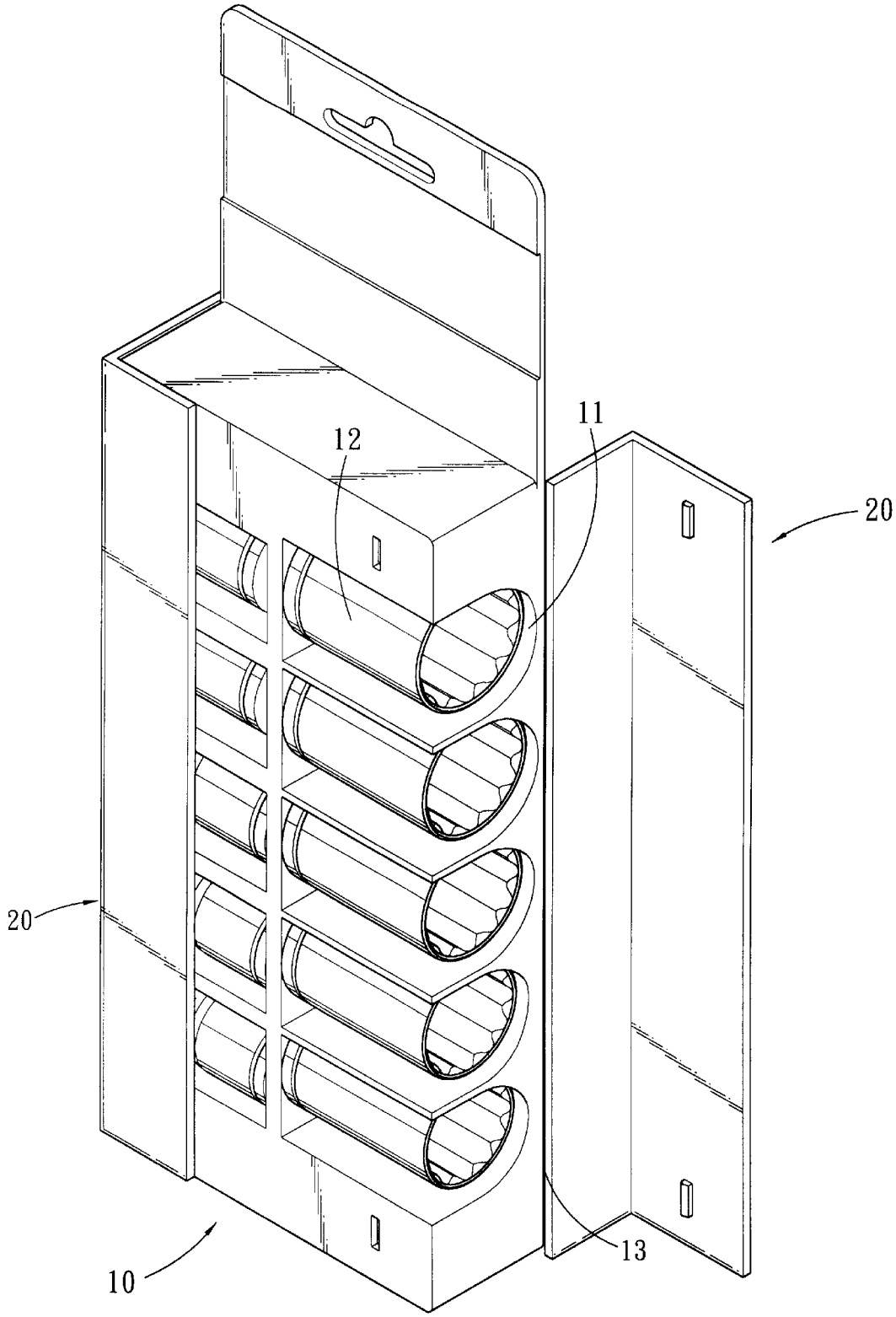
FIG. 1 PRIOR ART
FIG. 1 is a perspective view of a conventional tool box.
Figure 2:
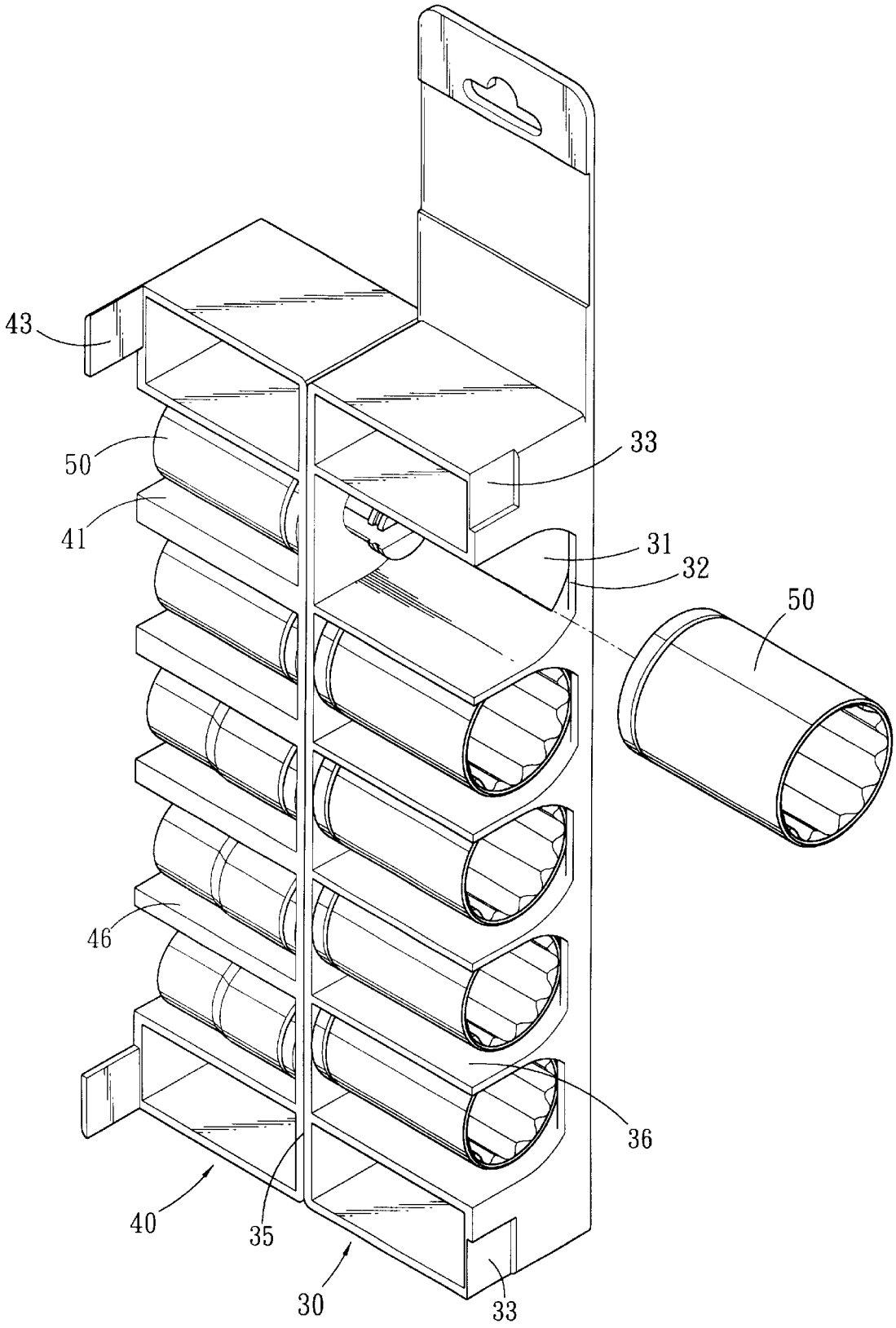
FIG. 2 is a perspective view to show a tool box of the present invention is in a opened condition.
Figure 3:
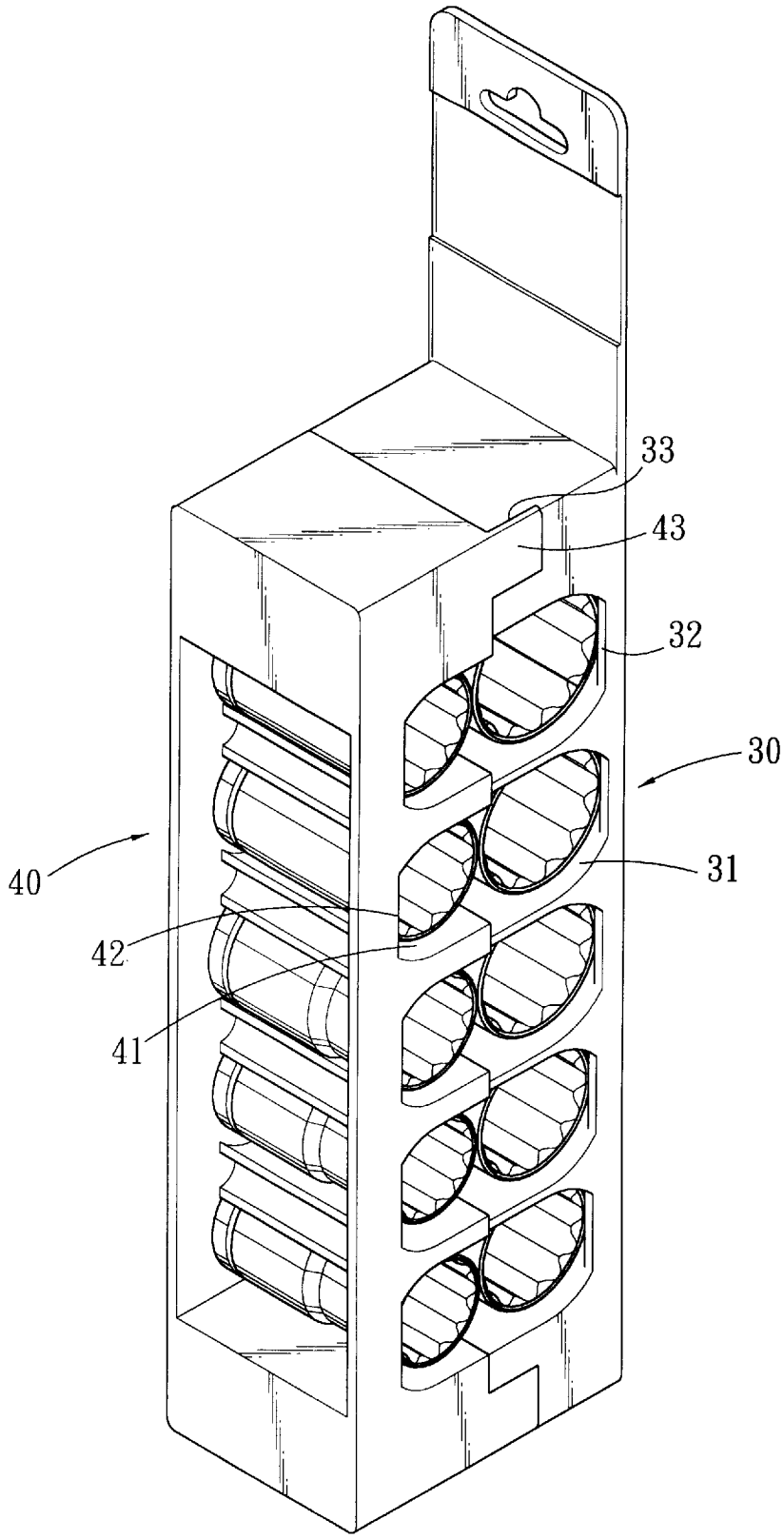
FIG. 3 is a perspective view to show the tool box of the present invention is in a closed condition.

Referring to FIGS. 2 and 3, the tool box in accordance with the present invention comprises a first casing body 30, a second casing body 40, and a hinge 35 is integrally connected between the first casing body 30 and the second casing body 40. The first casing body 30 has a plurality of compartments 31 respectively defined by a partition 36. Each of the compartments 31 is received a socket 50. Baffling sections 32 are respectively integrally formed at an opened side of the compartment 31 for contacting against an end edge of the socket 50 in order to prevent it from dropping out. Each of retainer recesses 33 (two retainer recesses in this embodiment) is integrally formed at an outer side of the upper and lower portion of the first casing body 30.

The second casing body 40 has a plurality of compartments 41 respectively defined by a partition 46. Each of the compartments 41 is received a socket 50. The compartments 41 are respectively corresponding to the compartments 31 of the first casing body 30. Baffling sections 42 are respectively integrally formed at an opened side the compartments 41 for contacting against an end edge of the socket 50 in order to prevent it from dropping out. The second casing body 40 comprises two retainers 43 extending from one side thereof remote from the hinge 35, and adapted for coupling to respective the retainer recesses 33 at the first casing body 30. Each of the retainers 43 of the second casing body 40 may be engaged with the retainer recesses 33 when the second casing body 40 rotates about the hinge 35 to contact with the first casing body 30. Referring to FIG. 3, the first casing body 30 and the second casing body 40 are pivotally closed together so as to close the tool box, thereby preventing the sockets from dropping out.

Referring to FIG. 2 again, the tool box in accordance with the present invention comprises a first casing body 30, a second casing body 40 and a hinge 35 is integrally connected between the first casing body 30 and the second casing body 40. The compartments 31 in the first casing body 30 are respectively corresponding to the compartments 41 in the second casing body 40, so the retainers 43 in the second casing body 40 will be engaged with the retainer recesses 33 of the first casing body 30 when the first casing body 30 and the second casing body 40 are pivotally rotated at the same time to contact each other and the side edge of each of the sockets 50 in the compartments 31 and 41 will abut against each other. In addition, the baffling sections 32, 42 of the compartments 31, 41 in the casing bodies 30, 40 will respectively contacts against the end edge of each sockets 50 to prevent it form dropping out, in such a manner, the sockets 50 can be received well in the tool box.

Figure 4:
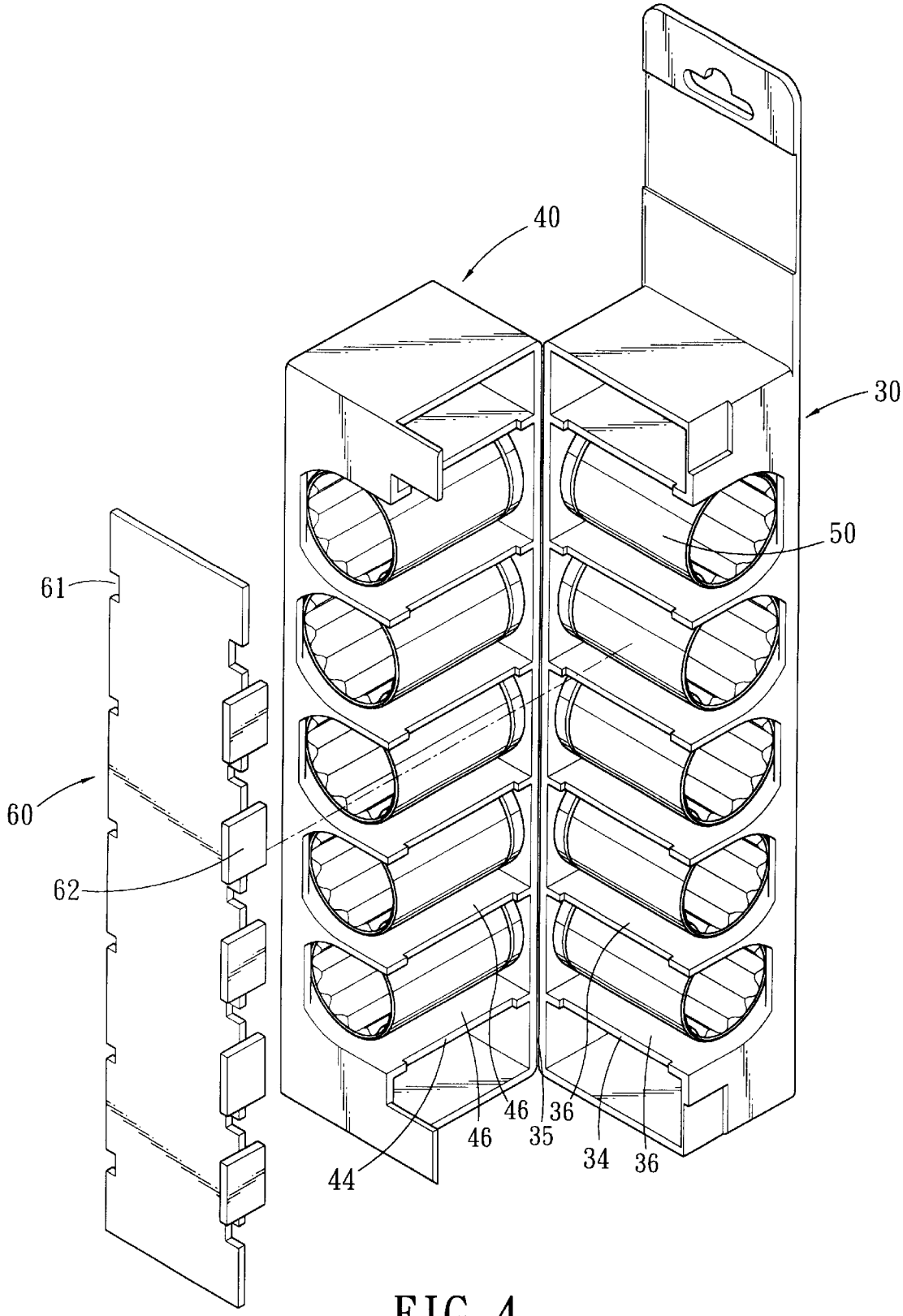
FIG. 4 is a partial exploded view of a second embodiment of the tool box in accordance with the present invention.
Figure 5:
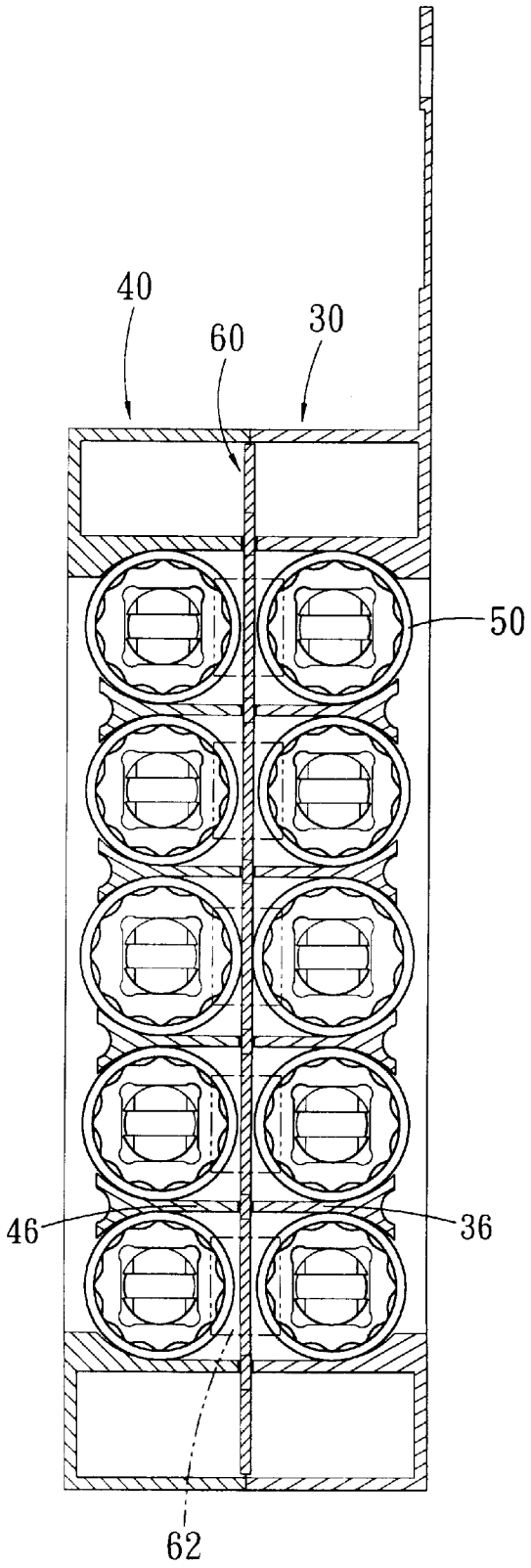
FIG. 5 is a cross sectional view of the second embodiment of the tool box in accordance with the present invention to show the sockets are received in the compartments.
Figure 6:
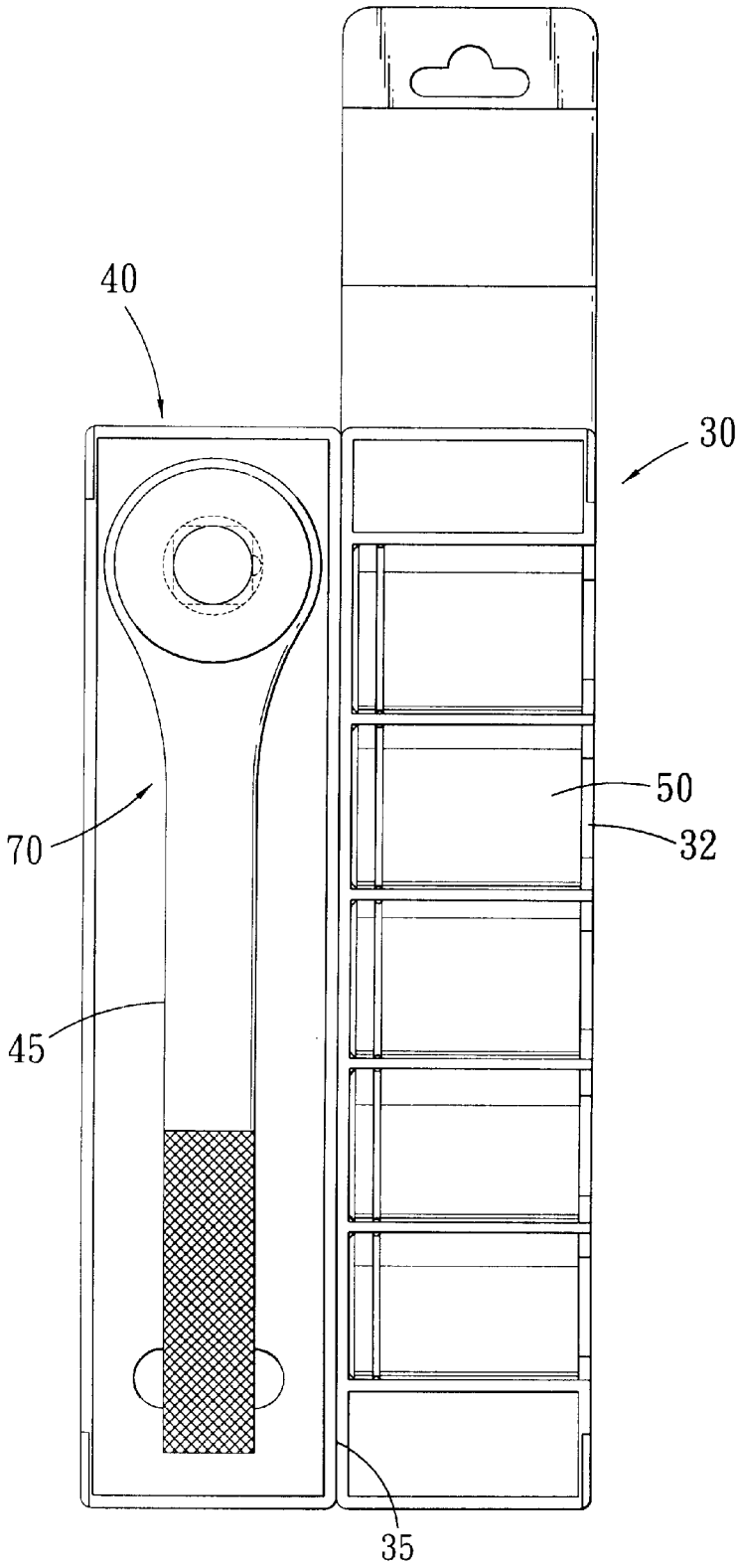
FIG. 6 is an illustrative view of a third embodiment of the present invention to show an opened tool box with a ratchet wrench and sockets are received therein together.
Figure 7:
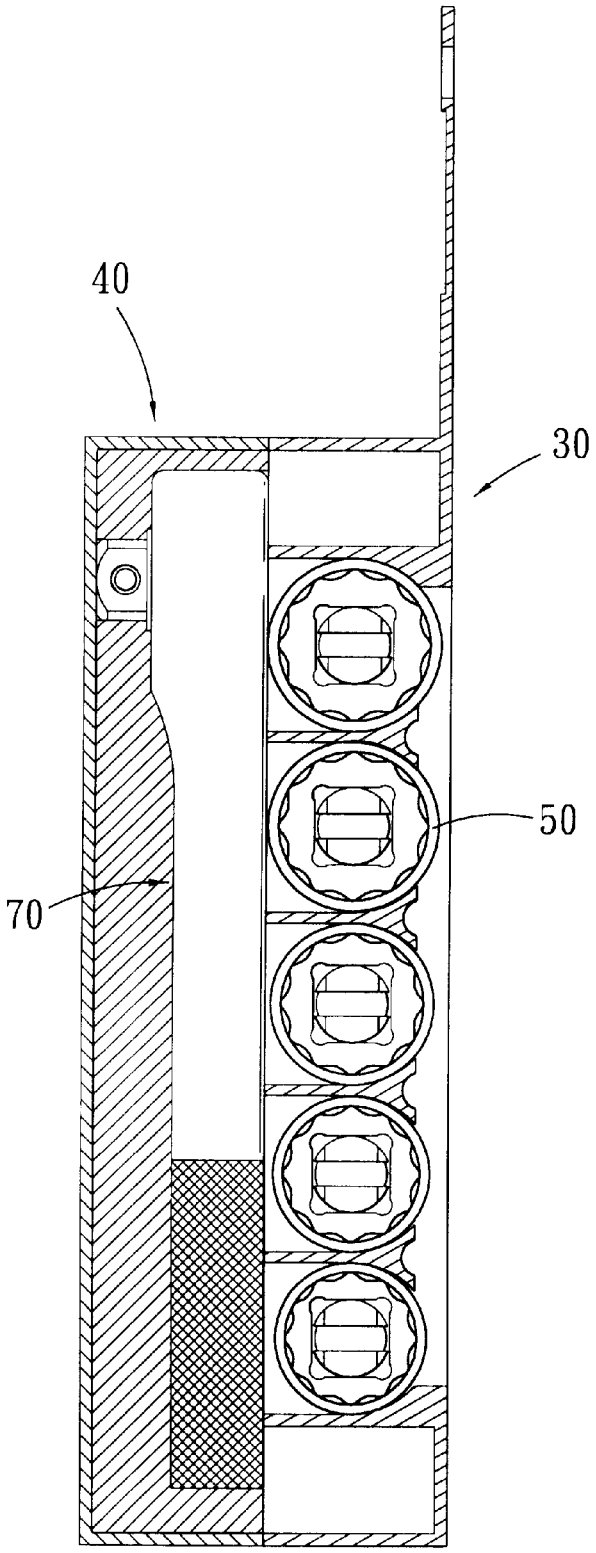
FIG. 7 is a cross sectional view of the third embodiment of the present invention to show a closed tool box with a ratchet wrench and sockets are received therein together.
Figure 8:
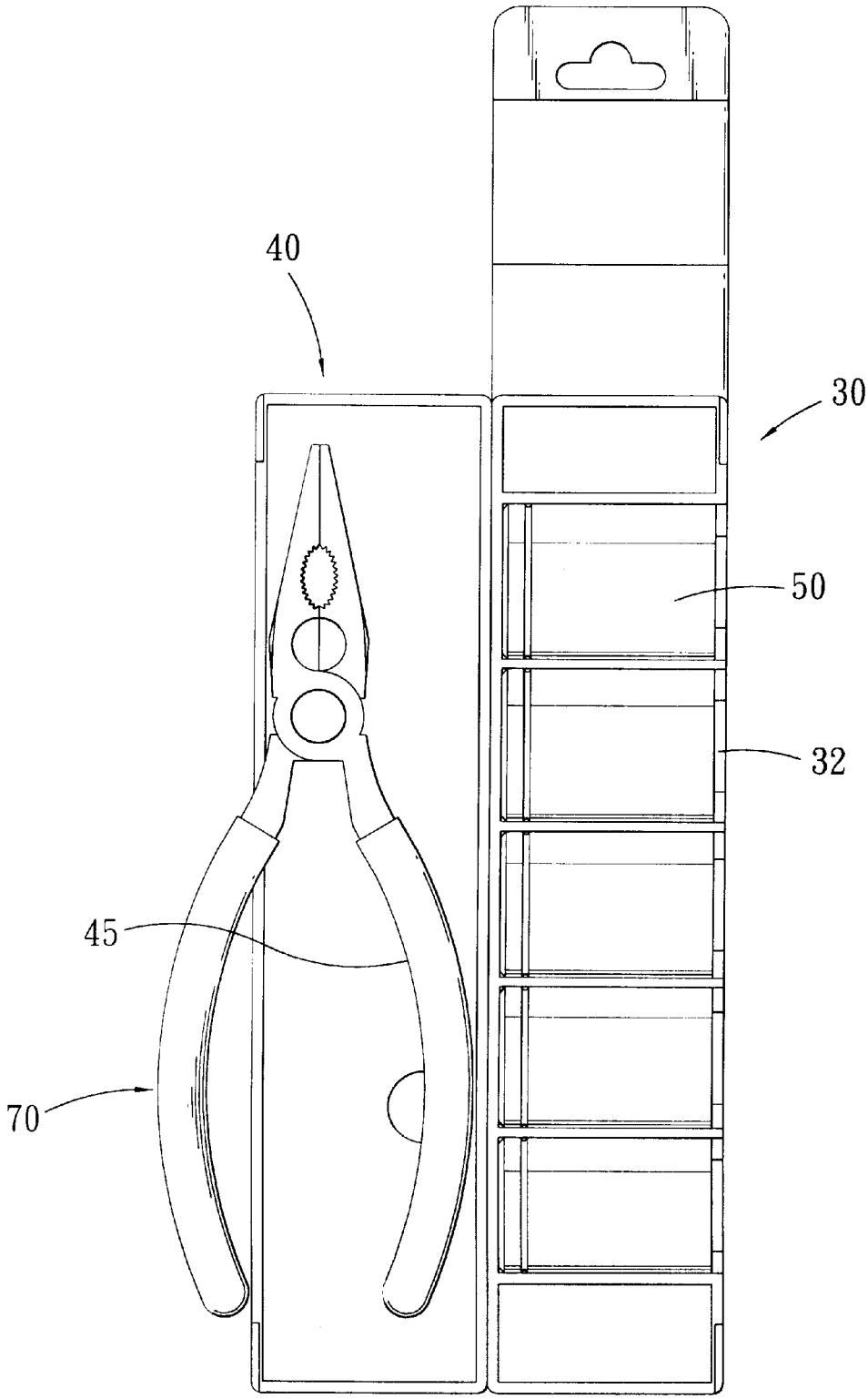
FIG. 8 is an illustrative view of a fourth embodiment of the present invention to show an opened tool box with a pincers are received therein.
Figure 9:
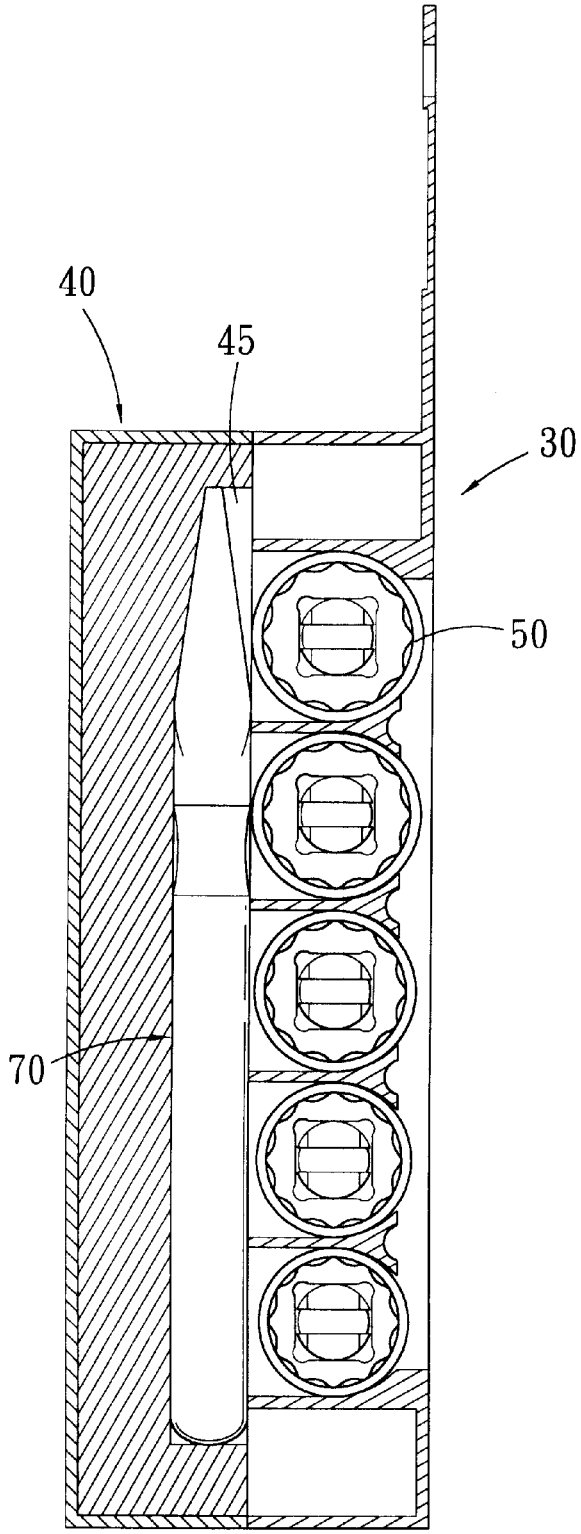
FIG. 9 is a cross sectional view of the fourth embodiment of the present invention to show a closed tool box with a pincers and sockets are received therein together.

Referring further to FIGS. 4 and 5, in which, there is a gap 34 formed in the partition 36 between the compartments 31 of the first casing body 30 and alike a gap 44 formed in the partition 46 between the compartments 41 of the second casing body 40. When the tool box is closed with the first casing body 30 abutting against the second casing body 40 between the compartments 31 and 41 a divider 60 is placed. The divider 60 oppositely has a plurality of notches 61 located at both sides thereof which are corresponding to the gaps 34, 44 in the casing bodies 30, 40 and has a plurality of plates 62 formed at one side thereof which are corresponding to the compartments 31, 41 in the casing bodies 30, 40, so that the divider 60 can be placed between the casing bodies 30 and 40 by the notches 61 mating with the gaps 34, 44 of the casing bodies 30 and 40. If when smaller sized sockets 50 are received in the compartments 31, 41 that the ends of the sockets in compartments 31, 41 of the first casing body 30 and the second casing body 40 can not contact against anything, they still be kept well in the compartments 31, 41 by placing the divider 60 between the first casing body 30 and the second casing body 40 with the plate 62 partially covering the ends of the compartments 31 and 41.

Referring to FIGS. 6–9, the second casing body 40 has a groove 45 corresponding to a ratchet wrench 70 (it can be pincers or the others) formed thereof and in which a ratchet wrench 70 (it can be pincers or the others) is received. When the casing bodies 30 and 40 are rotated about the hinge 35 and abuts each other, the sockets 50 can be kept well in the compartments 31 by virtue of a side of the ratchet wrench 70 contacting against a side edge of the socket 50 and simultaneously with baffling sections 32 of the compartments 31 in the first casing body 30 contacting against the end of the socket 50.

Figure 10:
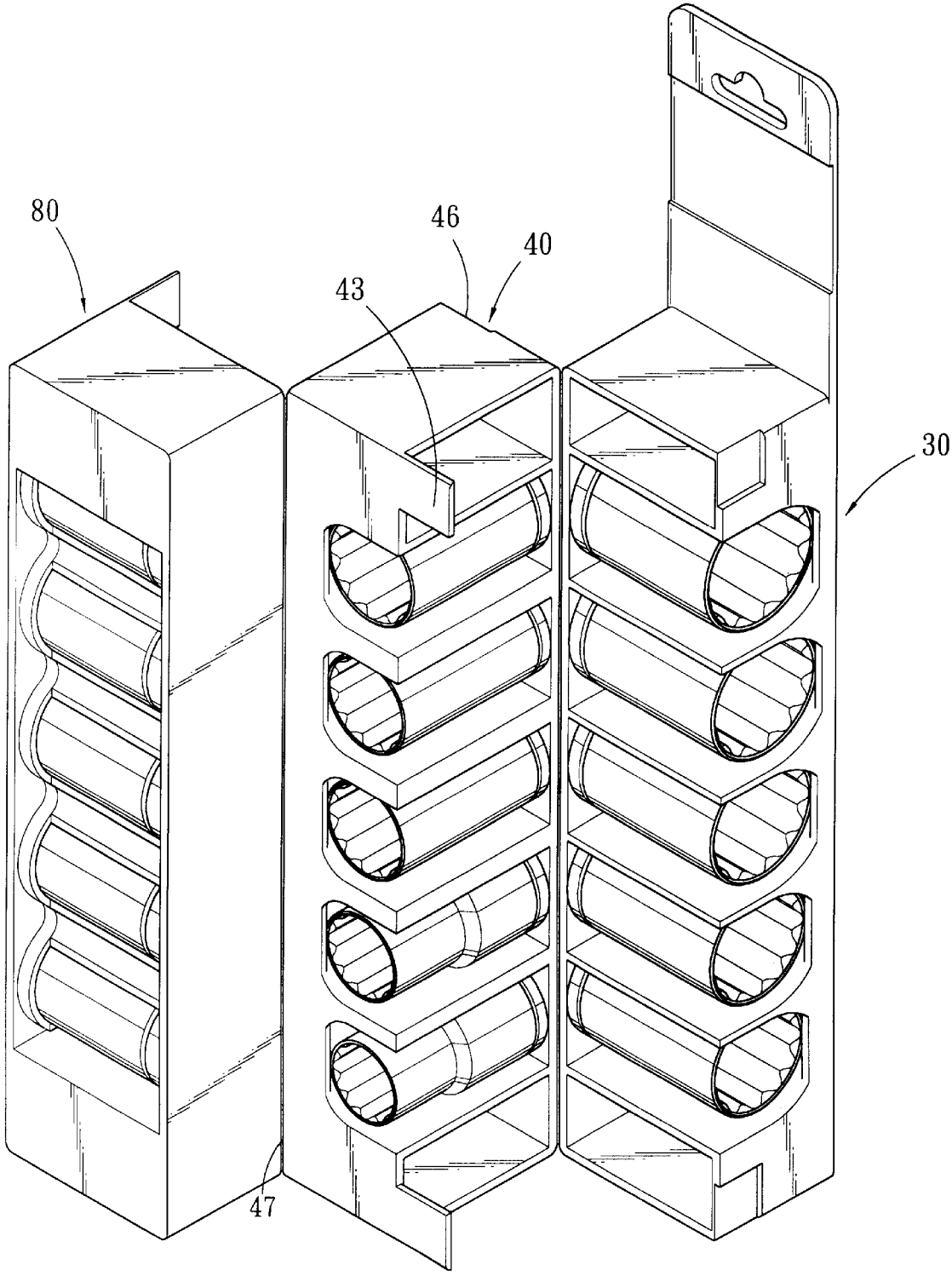
FIG. 10 is a perspective view of a fifth embodiment of the present invention to show a tool box is provided with three casing bodies.

Referring to FIG. 10, in which, the second casing body 40 of the tool box in accordance with the present invention can be pivotally connected at a hinge 47 with a third casing body 80 which is the same as the first casing body 30 and the second casing body 40, such that the tool box is able to receive more sockets.

While we have shown and described various embodiments in accordance with the present invention, it should be clear to those skilled in the art that further embodiment may be made without departing from the scope of the present invention.

What is claimed is:

1. A tool box comprising:

a first casing body having a plurality of compartments respectively defined by a partition and two retainer recesses respectively formed at the upper and lower portion of the first casing body, at an opened end of each compartments formed with a baffling section;

a second casing body having a plurality of compartments respectively defined by a partition corresponding to those in the first casing body, a hinge integrally connected between the first casing body and the second casing body, each compartments having a baffling section formed at an opened end of thereof, two retainers extending from one side of the second casing body remote from the hinge, and adapted for coupling to respective the retainer recesses at the first casing body when the two casing bodies rotatably closing together.

2. A tool box as claimed in claim 1, wherein each of partitions between the compartments of the first casing body has a gap formed thereof and alike each of partitions between the compartments of the second casing body has a gap formed thereof, a divider is placed between the first and second casing body, the divider oppositely has a plurality of notches located at both sides thereof corresponding to the respective gaps in the first and second casing body, which includes a plurality of plates formed at one side thereof corresponding to the compartments in the first and second casing body.

3. A tool box as claimed in claim 1, wherein the second casing body can be pivotally connected with a third casing body at a hinge.

4. A tool box comprising:

a first casing body having a plurality of compartments respectively defined by a partition and two retainer recesses respectively formed at the upper and lower portion of the first casing body, at an opened end of each compartments formed with a baffling section;

a second casing body having a groove corresponding to a tool, a hinge integrally connected between the first casing body and the second casing body, two retainers extending from one side of the second casing body remote from the hinge, and adapted for coupling to respective the retainer recesses at the first casing body when the two casing bodies rotatably closing together.

* * * * *